US007584967B2

(12) United States Patent
Webb et al.

(10) Patent No.: US 7,584,967 B2
(45) Date of Patent: Sep. 8, 2009

(54) CASINO GAME WITH CARD PICK PLAYER CHOICE (U-PIK)

(75) Inventors: Derek J. Webb, Derby (GB); Shenli Ko, Las Vegas, NV (US)

(73) Assignee: Prime Table Games LLC, Las Vegas, NV (US)

( * ) Notice: Subject to any disclaimer, the term of this patent is extended or adjusted under 35 U.S.C. 154(b) by 176 days.

(21) Appl. No.: 11/668,043

(22) Filed: Jan. 29, 2007

(65) Prior Publication Data

US 2008/0179830 A1 Jul. 31, 2008

(51) Int. Cl.
*A63F 1/00* (2006.01)

(52) U.S. Cl. ..... 273/292; 273/309; 463/12

(58) Field of Classification Search ..... 273/292
See application file for complete search history.

(56) References Cited

U.S. PATENT DOCUMENTS

| | | | | |
|---|---|---|---|---|
| 5,294,128 | A | 3/1994 | Marquez | |
| 5,322,295 | A * | 6/1994 | Cabot et al. | 273/292 |
| 5,657,993 | A * | 8/1997 | Merlino et al. | 273/292 |
| 5,732,950 | A | 3/1998 | Moody | |
| 5,816,914 | A | 10/1998 | Wichinsky | |
| 5,823,873 | A | 10/1998 | Moody | |
| 6,048,267 | A | 4/2000 | Wichinsky | |
| 6,129,357 | A | 10/2000 | Wichinsky | |
| 6,132,311 | A | 10/2000 | Williams | |
| 6,135,453 | A | 10/2000 | Srichayaporn | |
| 6,270,405 | B1 | 8/2001 | Ferguson | |
| 6,443,456 | B1 | 9/2002 | Gajor | |
| 6,471,587 | B1 | 10/2002 | Wood et al. | |
| 6,511,068 | B1 | 1/2003 | Sklansky et al. | |
| 6,561,898 | B2 | 5/2003 | Moody | |
| 6,959,928 | B2 | 11/2005 | Schultz | |
| 7,059,604 | B1 | 6/2006 | Richards et al. | |
| 7,201,654 | B1 | 4/2007 | Jarvis et al. | |
| 2003/0011127 | A1 * | 1/2003 | Vancura et al. | 273/236 |
| 2005/0082758 | A1 * | 4/2005 | Sklansky et al. | 273/292 |
| 2005/0107148 | A1 * | 5/2005 | Webb | 463/13 |
| 2005/0218596 | A1 | 10/2005 | Adam et al. | |
| 2006/0043669 | A1 * | 3/2006 | Gumina | 273/139 |
| 2006/0119044 | A1 | 6/2006 | Kekempanos et al. | |
| 2006/0197286 | A1 * | 9/2006 | Shackleford | 273/292 |
| 2006/0255541 | A1 * | 11/2006 | McBride | 273/292 |
| 2006/0267284 | A1 | 11/2006 | Jackson | |
| 2006/0281514 | A1 | 12/2006 | Loewenstein et al. | |
| 2007/0040333 | A1 * | 2/2007 | Au-Yeung | 273/292 |
| 2007/0205559 | A1 * | 9/2007 | Webb et al. | 273/292 |

* cited by examiner

*Primary Examiner*—Gene Kim
*Assistant Examiner*—Joseph B Baldori
(74) *Attorney, Agent, or Firm*—Nixon & Vanderhye P.C.

(57) ABSTRACT

Each player participating in a casino game makes two wagers and receives two cards. A dealer receives at least one card, and the dealer deals at least two community hands. Each player subsequently forms two player hands by associating one each of the two cards with each of the community hands. The dealer forms a dealer hand by associating the at least one card with one of the community hands. Wagers are resolved by comparing the two player hands with the dealer hand. The game may also include an optional proposition wager that is resolved based on the initial two cards dealt to each player.

42 Claims, 1 Drawing Sheet

CASINO GAME WITH CARD PICK PLAYER CHOICE (U-PIK)

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to casino games and, more particularly, to casino games utilizing community cards where a player chooses between different community card hands by placing cards in association with a respective community hand.

Casino operators are continually searching for ways to make casino table games more attractive and player friendly. New poker derivatives such as Caribbean Stud, Let It Ride, Pai Gow Poker, and Three Card Poker have made a significant contribution. To facilitate the success of a house-banked casino game, it is important that the casino advantage is reasonable, that the game is relatively easy to understand for both players and dealers, and that there is at least a player perception of a reasonable chance for a player premium hand to defeat the dealer in a competition mode or win an increased payout in a proposition mode or both.

Casino patrons also seek variety in game play. It is helpful for player acceptance of a new game if the game embodies principles of conventional games, such as Blackjack, Baccarat, Poker, etc., while adding features that make the games more exciting and player-friendly.

BRIEF SUMMARY OF THE INVENTION

The present description encompasses a house-banked casino game where players are provided a choice between multiple community hands. In a preferred operating mode, after making two initial wagers, the players receive two or more cards, and subsequently a pair of community hands, which may include only one card each, are dealt by the dealer. The player then associates the initial dealt cards with respective ones of the community hands (e.g., by placing each card in a specific area on the table), which serves to designate the player's community hand choice for each of the dealt cards. In one operating mode, at least one concealed card, which may be shared by the pair of community hands, is dealt by the dealer. In another operating mode, the dealer also receives a card and forms a dealer hand by associating the dealer card with the community hand that gives the dealer the best possible dealer hand. An optional proposition wager may be included with payout determined based on the initial cards dealt to the player.

By permitting players to choose between community hands/cards, players have a perception that premium hands are more easily attained.

In an exemplary embodiment of the invention, a method of playing a casino game includes the steps of (a) a player placing a first wager and a second wager, which in one embodiment are required to be equal; (b) dealing at least two cards to the player; (c) dealing at least a first community hand including at least a first community card and a second community hand including at least a second community card; (d) the player forming two player hands, each including at least one of the at least two cards dealt to the player in step (b) and one of the first community hand and the second community hand; and (e) resolving the first and second wagers based on the two player hands according to game rules. The method may further include, prior to step (c), dealing at least one card to a dealer, and after step (c), forming a dealer hand including the at least one card dealt to the dealer and one of the first community hand and the second community hand, wherein step (c) is practiced by comparing a value of the dealer hand with the values of the player hands. In this context, step (e) may be practiced by paying a payout on the first wager if a first of the player hands has a value that exceeds the value of the dealer hand, and paying a payout on the second wager if a second of the player hands has a value that exceeds the value of the dealer hand. In a preferred operating mode, hand values are determined based on a modulo-10 Baccarat counting system. The modulo-10 Baccarat counting system is such that if the total value sum of a hand equals or exceeds 10, then 10 is subtracted from the total, i.e., only the last digit is used as the value of the hand.

Step (e) may be practiced by dealing three cards including two exposed cards and one concealed card, the first community hand consisting of one of the exposed cards and the concealed card, and the second community hand consisting of the other of the exposed cards and the concealed card. In this context, step (d) may be practiced by the player placing the at least one of the at least two cards dealt to the player in step (b) in association with one of the first and second community hand as a first player hand, and placing the at least other of the at least two cards dealt to the player in step (b) in association with the other of the first and second community hand as a second player hand. A value of the first player hand is initially determined based on the at least one of the at least two cards dealt to the player in step (b) and the exposed card of the associated first or second community hand, the value being adjusted based on the concealed card of the associated first or second community hand if the concealed card improves the value of the first player hand. Similarly, a value of the second player hand is initially determined based on the at least other of the at least two cards dealt to the player in step (b) and the exposed card of the associated first or second community hand, the value being adjusted based on the concealed card of the associated first or second community hand if the concealed card improves the value of the second player hand.

Step (e) is preferably practiced by paying a payout on the first wager if the value of the first player hand exceeds the dealer hand value, and paying a payout on the second wager if the value of the second player hand exceeds the dealer hand value. In one playing mode, if the dealer hand value is less than 6, step (e) is practiced by paying a payout on the first and second wagers regardless of the first and second player hand values. If the dealer hand value is greater than 5, step (e) is practiced by paying a payout on the first wager if the value of the first player hand exceeds the dealer hand value and paying a payout on the second wager if the value of the second player hand exceeds the dealer hand value. Preferably, the payout is 1 to 1, and the first and second wagers are pushed for tied hands.

If the dealer hand value is greater than 5 and if the first and second player hand values are equal to the dealer hand value, the method may include a step of paying a double hand bonus payout based on one of the first and second wagers. In this context, the double hand bonus payout may be equal to two times one of the first and second wager.

Prior to step (b), the players may be provided an option to place a proposition wager, wherein the proposition wager is resolved based on the at least two cards dealt to the player in step (b). In this regard, the step of resolving the proposition wager may be practiced by paying a payout on the proposition wager if the at least two cards dealt to the player in step (b) form a pair, preferably 2s-9s. A higher payout is paid on the proposition wager if the at least two cards dealt to the player in step (b) form a suited pair. Alternatively or additionally, the proposition wager may be resolved by paying a payout if the at least two cards dealt to the player in step (b) have a combined value according to the modulo-10 Baccarat scoring system of 8 or 9, a higher payout if suited.

In another exemplary embodiment of the invention, in a method of playing a casino game, each player makes two wagers and receives two cards, a dealer receives at least one card, and the dealer deals at least two community hands. Each player subsequently forms two player hands by associating one each of the two cards with each of the community hands. The dealer forms a dealer hand by associating the at least one card with one of the community hands. The wagers are resolved by comparing the two player hands with the dealer hand.

In yet another exemplary embodiment of the invention, a method of playing a casino Baccarat game, wherein hand values are determined according to a modulo-10 Baccarat scoring system, includes the steps of (a) a player placing a Left wager and a Right wager; (b) dealing two cards to the player and one card to a dealer; (c) dealing three community cards including an exposed first card, a concealed second card, and an exposed third card, the three community cards defining two community hands, a first community hand including the exposed first card and the concealed second card, and the second community hand including the exposed third card and the concealed second card; (d) the player forming a first player hand by placing one of the two cards dealt to the player in step (b) in association with one of the first and second community hands; (e) the player forming a second player hand by placing the other of the two cards dealt to the player in step (b) in association with the other of the first and second community hands; (f) after step (e), revealing the concealed second card; (g) determining a value of the first player hand and a value of the second player hand, wherein the now-revealed second card forms part of the first or second player hand only if the second card improves the hand value, respectively; (h) the dealer forming a dealer hand by associating the dealer card with the first or second community hand that results an optimum hand value and determining a dealer hand value; and (i) resolving the Left wager based on a comparison of the player first hand value with the dealer hand value, and resolving the Right wager based on a comparison of the player second hand value with the dealer hand value.

BRIEF DESCRIPTION OF THE DRAWINGS

These and other aspects and advantages of the present invention will be described in detail with reference to the accompanying drawing, in which.

DETAILED DESCRIPTION OF THE INVENTION

Figure 1:
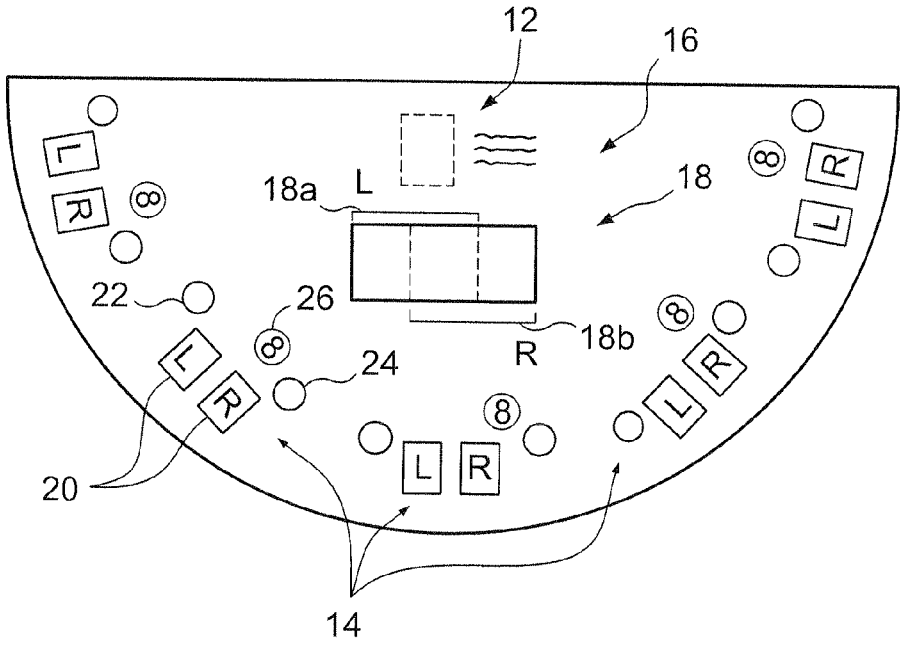
FIG. 1 is a plan view of an exemplary table layout according to the present invention.

In the following detailed description, the method and apparatus according to the present invention will be described in conjunction with its application to a casino environment, thus incorporating wagers, payouts etc. Those of ordinary skill in the art will readily comprehend alternative applications of the present invention outside a casino environment, and the invention is not necessarily meant to be limited to the described application. For example, the game may be embodied in a video game that is played for entertainment purposes against a computer or the like. Alternatively, players may play the game without wagers in a head-to-head format with one player acting as a dealer, and the other player simply keeping track of wins and losses.

FIG. 1 shows a game table including a playing area 10 having a dealer area 12, a plurality of player areas 14, promotional markings and game rules 16, and a community card area 18. Although FIG. 1 shows five player areas 14, more players can participate in the game at a time. In preferred embodiments, the table layout 10 may include between seven and ten player areas 14, although seven player areas 14 is most preferred.

Each player area 14 includes a player card area 20 and spaces for a Left wager 22 and a Right wager 24. An additional wager area 26 is also provided for an optional proposition wager. The community card area 18 includes spaces for a Left community card hand 18*a* and a Right community card hand 18*b*.

In a basic playing mode, the player makes at least two bets, and the player is dealt a number of cards. At least two communal hands are dealt, which can share at least one card that is dealt face down between the communal hands. The number of the communal hands preferably equals the number of the player bets. At least one of the communal hands is revealed, and the player has to split his cards into as many hands as there are communal hands. For each split hand, the player has to pick a communal hand to match. The game may include also dealing the dealer a number of cards.

If the dealer does not receive a hand, the player hand is played against a pay table with predetermined winning combinations and payouts. If the dealer receives a hand, all of the player hands play against the same dealer hand. As noted, in one operating mode, no more than one communal hand is revealed initially. As such, at least one of the player split hands is matched with a "blind" communal hand.

In forming the player hands, the split hands may be required to have an equal number of cards. Alternatively, the split hands may have an unequal number of cards. For example, if the player receives four cards, then one hand can have one card and the other can have three cards. When the split hands have an unequal number of cards, then each split hand can play against its own pay table and have its own ranking. For example, the hand having fewer cards can be played as a three-card poker hand, whereas the hand having more cards can be played as a four-card poker hand.

The player may be provided an option to match more than one of his hands with any one particular communal hand. The player may also be provided an option to increase the initial wager on any of the split hands.

In a preferred playing mode, each player is required to place two competition wagers, which preferably are required to be of equal amounts, on two player hands at Left wager area 22 and Right wager area 24, respectively. In a preferred operating mode, the two player hands play against one dealer/banker hand. Players are also provided an option to place a proposition wager (a so-called 8-Up Wager) at proposition wager area 26. In this operating mode, hand values are determined using the modulo-10 Baccarat scoring system, where all face cards and 10's count as zero, aces count as 1 and all other cards are counted at face value.

After placing wagers, two cards are dealt to each player at player card area 20 and a concealed card is dealt to the dealer at dealer area 12. The dealer deals three community cards face down to the community card area 18 and subsequently reveals the left and right community cards, which constitute, respectively, a part of the left hand and a part of the right hand. The center community card remains concealed.

Each player subsequently chooses which card to play in the left hand and which card to play in the right hand by placing one of their cards dealt to player card area 20 in each of the player left and right card areas. In this manner, each player thereby forms two player hands by placing cards in association with a left community card/hand and a right community card/hand, respectively. After all players have acted, the dealer reveals the center community card, which forms part of each of the left and right community hands. That is, the center community card is shared by both left and right hands. Now each player has two hands of three cards, each with the center community card playing in each of the left and right hands.

Using the modulo-10 Baccarat scoring system, the player hands and dealer hand are evaluated. When a player hand is being evaluated, the combined value of the two associated cards (left or right), ignoring the center card, is determined. Subsequently, if the center community card can be used to improve the hand, then it automatically forms a part of the hand. This valuation is repeated for the other player hand.

The dealer plays the best of the two possible hands based on the one card dealt to the dealer. In this manner, the dealer evaluates the dealer hand by first determining the value of the left hand, then determining the value of the right hand. The dealer selects the best of the two hands and announces its value. If the dealer hand value is less than 6, the dealer automatically loses to all players. If the dealer hand is greater than 5, then the dealer will evaluate and compare each of the two player hands with the dealer hand, where the higher total wins. Tied hands are pushed. A winning player hand is preferably paid 1 to 1 on the respective competition wager.

When both of the player hands tie the dealer hand at a value greater than 5, the player's two bets are pushed, but the player may receive a "double tie" bonus equal to two times the player's left wager (which equals the sum of both wagers in the operating mode where both wagers must be equal). That is, the "double tie" bonus is paid as follows:

| Player LH/RH Score | Dealer Score |
|---|---|
| 9/9 | 9 |
| 8/8 | 8 |
| 7/7 | 7 |
| 6/6 | 6 |

The optional proposition wager is based on the player's own two cards; i.e., the initial two cards dealt to the player. If the two cards form a pair of 2's-9's or total 8 or 9, the 8-Up Wager wins according to one of the below pay tables:

PAY TABLE A

| Player's two cards | Suited | Unsuited |
|---|---|---|
| Pair of 2's-9's | 10 | 2 |
| 8 or 9 points | 6 | 2 |

PAY TABLE B

| Player's two cards | Suited | Unsuited |
|---|---|---|
| Pair of 2's-9's | 9 | 2 |
| 8 or 9 points | 6 | 2 |

PAY TABLE C

| Player's two cards | Suited | Unsuited |
|---|---|---|
| Pair of 2's-9's | 14 | 2 |
| 8 or 9 points | 5 | 2 |

The same modulo-10 Baccarat scoring system applies when adding the two cards. As seen in the Tables, a winning hand pays 2 to 1 if it is unsuited. If the two cards are suited, e.g., 3 of Spades and 5 of Spades, then the hand is paid higher odds. If the two cards are suited and form a pair, the winning hand pays the highest odds.

The game is preferably played with 6 or 8 decks of standard playing cards.

Although the preferred game mode described above references "cards," the use of such a term is not intended to be limited to playing cards; rather, the term "cards" used herein is intended to encompass any suitable insignia such as conventional playing cards, dice, tiles or the like. Moreover, in the preferred operating mode, hand values are determined according to the modulo-10 Baccarat scoring system, but the invention is not necessarily meant to be limited to such a scoring system. Other scoring methodologies such as in Blackjack convention or the like may alternatively be utilized. Moreover, values may be numerical or combinatorial. Conventional poker rankings are an example of combinatorial hand values. Still further, the number of wagers, player cards, dealer cards, community cards and the like may be altered without departing from the scope of the present invention.

In a three card match maker variation, the player makes two equal bets and receives two cards. Three communal cards are dealt to the community card area. The left and right communal cards are revealed. The player splits his two cards and places each card in the card area corresponding to the selected communal card. The player has the option to pick the same card for both wagers. The dealer then reveals the center concealed communal card. The dealer then evaluates each player hand, and wagers are paid according to a three-card poker pay table.

In a related three-card match maker variation, the player makes two equal bets, and the player is provided an option to make a "flush up" bonus bet. The player is dealt two cards, and the dealer is dealt one card. Three communal cards are dealt to the community card area. The left and right communal cards are revealed. The player then splits his two cards and places each card in the card area corresponding to the selected communal card. The dealer then reveals the dealer card and the center concealed communal card. The dealer selects the communal card that makes his best three-card poker hand. The dealer then evaluates each player hand, where both player hands play against the dealer hand. The player's bonus bet is paid on the best of the two hands according to a three-card poker pay table.

The player may be provided with an option to pick the same card for both wagers. The player may also be provided with an option to double down, which may be limited to just one hand. The player can make an additional wager that he will win both hands, which wager preferably equals the initial wager. As another option in the three-card match maker variation, the dealer may be permitted to use the three communal cards to form the dealer hand if the use of the three cards would result in a better hand.

In a four-card match maker variation, the player makes two equal wagers and receives four cards. Four communal cards are dealt to the community card area. The left and right communal cards are revealed. The player splits the four cards into two two-card hands and places each pair of cards in the card area corresponding to the selected communal card. The player is provided an option to pick the same card for both wagers. The dealer then reveals the center two concealed communal cards and evaluates each player hand. The two wagers are paid according to a four-card poker pay table.

In another four-card match maker variation, the player makes two equal wagers and is provided an option to make a bonus wager. The player is dealt four cards, and the dealer is dealt two cards. Four communal cards are dealt to the community card area. The left and right communal cards are revealed. The player splits his four cards into two two-card hands and places each pair of cards in the card area corresponding to the selected communal card. The dealer reveals the dealer cards and the center two concealed communal cards. The dealer selects the communal card resulting in the best four-card poker hand. The dealer then evaluates each player hand, where both player four-card poker hands play against the same dealer hand. The bonus wager is paid on the best of the two hands according to a four-card poker pay table.

The player may be provided an option to pick the same card for both wagers. The player may also be provided an option to double down, which may be limited to just one hand. An additional wager may be available that the player will win both hands, which wager is preferably equal to the initial wager.

The three- and four-card match maker variations described above may be adapted to five- and seven-card playing modes as well.

In a split poker variation, a player makes a three-card wager and a four-card wager, which are preferably equal. The player is dealt five cards. Three communal cards are dealt to the community card area. The left and right communal cards are revealed. The player picks four of his five cards for his four-card poker wager and places the remaining card in the card area corresponding to the selected communal hand for his three-card poker wager. The dealer reveals the center concealed communal card. The player thus has a four-card poker hand that does not use any of the communal cards, and the player has a three-card poker hand comprising his card, the selected communal card, and the center communal card. The dealer then evaluates each player hand, where the three-card wager is paid according to a three-card poker pay table, and the four-card wager is paid according to a four-card poker pay table. In one alternative, the player may be dealt six cards and permitted to use five cards to form a best four-card poker hand.

In an alternative split poker variation, the player makes a three-card wager and a four-card wager, which are preferably equal. The player is dealt four cards, and three communal cards are dealt to the community card area. The left and right communal cards are revealed. The player picks three of his four cards for the four-card poker wager and places the three cards in the card area corresponding to the selected communal hand. The player places the remaining card in the card area corresponding to the selected communal hand for the three-card wager. The player can pick the same communal hand for both the three-card and four-card wagers. The dealer subsequently reveals the center concealed communal card. The player now has a four-card poker hand and a three-card poker hand. Both hands use the respective player's card(s), the respective pick card and the center communal card. The dealer then evaluates each player hand, where the three-card wager is paid according to a three-card poker pay table, and the four-card wager is paid according to a four-card poker pay table.

In a split Pai Gow variation using tiles, the player makes two equal wagers. The player receives two tiles, and the dealer receives one tile. Three communal tiles are dealt to the community tile area, and the left and right communal tiles are revealed. The player splits his two tiles and places each tile in the betting area corresponding to the selected communal tile. The dealer then reveals the center concealed communal tile and the dealer tile. The dealer picks the better of the two communal tiles to make the dealer's best Pai Gow hand. As an alternative, the dealer may be permitted to use just the community tiles if the three community tiles make the best dealer hand. The dealer then evaluates each player hand. If the three tiles of the selected communal hand make a straight, then all three tiles are used. Otherwise, the best two of the three tiles, including the combination of the center and the selected tiles are used to form the hand. The higher two-tile Pai Gow ranking wins, with hand rankings as (winning hands are paid even money):

Straight (this is the only hand that must use all three tiles)
Pair
Wong
Gong
9-0

In a variation using dice, the player makes two equal wagers and receives two dice in a dice cup. Three community dice are rolled and placed in one line in a community dice area, and the left and right community dice are revealed. The player shakes his dice cup. He splits his two dice and lets the dealer place each die in the betting area corresponding to the selected community die. The dealer then reveals the center concealed community die. The player will be paid according to a pay table based on the combination of each player die with each community hand that comprises the center die and the die the player picked to associate with his die:

| 3-die Combination | Pay (to 1) |
|---|---|
| 666 | 8 |
| 555 | 5 |
| Triple | 3 |
| 456 | 2 |
| Straight | 1 (123, 234 and 345) |
| Pair of 4s, 5s or 6s | 1 |

As would be apparent to those skilled in the relevant art, the embodiments described above can be embodied in a wide variety of forms and media including, but not limited to, single player slot video machines, multi-player slot video machines, electronic games and devices, lottery terminals, scratch-card formats, software as well as in-flight, home and Internet entertainment. In addition, the described embodiments can also be readily implemented as a computer program product (e.g., floppy disks, compact disks, etc.) comprising a computer readable medium having control logic reported therein to implement the features of the invention as described in relation to the other preferred embodiments. The control logic can be loaded into the memory of a computer and executed by a central processing unit (CPU) to perform the operations described herein.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a casino game comprising:

(a) using a table or at least one apparatus a player placing at least a first wager and a second wager respectively for two separate player hands;

(b) dealing at least two cards to the player;

(c) dealing at least a first community hand and a second community hand by dealing at least three cards including at least two exposed cards and at least one concealed card, the first community hand consisting of at least one of the at least two exposed cards and the at least one concealed card, and the second community hand consisting of at least the other of the at least two exposed cards and the at least one concealed card;

(d) the player forming the two separate player hands prior to exposing the at least one concealed card by selecting one of the first community hand and the second community hand and combining the selected hand with at least one of he at least two cards dealt to the player in step (b) and by selecting the other of the first community hand and the second community hand and combining the selected other hand with another of the at least two cards dealt to the player in step (b); and (e) resolving the first and second wagers based on the two separate player hands according to game rules.

2. A method according to claim 1, further comprising, prior to step (c), dealing at least one card to a dealer, and after step (c), forming a dealer hand including the at least one card dealt to the dealer and one of the first community hand and the second community hand, wherein step (c) is practiced by comparing a value of the dealer hand with values of the player hands.

3. A method according to claim 2, wherein step (e) is practiced by paying a payout on the first wager if a first of the player hands has a value that exceeds the value of the dealer hand, and paying a payout on the second wager if a second of the player hands has a value that exceeds the value of the dealer hand.

4. A method according to claim 2, wherein hand values comprise at least one of a hand numerical value or a hand rank.

5. A method according to claim 4, wherein hand numerical values are determined based on one of a modulo-10 Baccarat counting system, a Blackjack counting system, or dice values, and wherein hand ranks are determined based on one of Poker rankings or Pai Gow tiles rankings.

6. A method according to claim 1, wherein step (d) is practiced by the player placing the at least one of the at least two cards dealt to the player in step (b) in association with one of the first and second community hand as a first player hand, and placing the at least other of the at least two cards dealt to the player in step (b) in association with the other of the first and second community hand as a second player hand.

7. A method according to claim 6, wherein a value of the first player hand is initially determined based on the at least one of the at least two cards dealt to the player in step (b) and the exposed card of the associated first or second community hand, the value being adjusted based on the concealed card of the associated first or second community hand if the concealed card improves the value of the first player hand, and wherein a value of the second player hand is initially determined based on the at least other of the at least two cards dealt to the player in step (b) and the exposed card of the associated first or second community hand, the value being adjusted based on the concealed card of the associated first or second community hand if the concealed card improves the value of the second player hand.

8. A method according to claim 6, wherein values of the first and second player hands are determined based on a modulo-10 Baccarat counting system, a Blackjack counting system, or dice values, and wherein hand ranks are determined based on one of Poker rankings or Pai Gow tiles rankings.

9. A method according to claim 8, further comprising, prior to step (c), dealing at least one card to a dealer, and after step (c), and after exposing the concealed card, forming a dealer hand consisting of a highest value hand between a first consideration hand consisting of the at least one dealer card and the first community hand and a second consideration hand consisting of the at least one dealer card and the second community hand, the dealer hand value being determined on the same basis as the player hands.

10. A method according to claim 9, wherein step (e) is practiced by comparing the value of the dealer hand with the value of the first and second player hands, respectively.

11. A method according to claim 10, wherein step (e) is practiced by paying a payout on the first wager if the value of the first player hand exceeds the dealer hand value, and paying a payout on the second wager if the value of the second player hand exceeds the dealer hand value.

12. A method according to claim 10, wherein if the dealer hand value is greater than 5 and if the first and second player hand values are equal to the dealer hand value, the method comprising paying a double hand bonus payout based on one of the first and second wagers.

13. A method according to claim 12, wherein the double hand bonus payout is equal to two times one of the first and second wager.

14. A method according to claim 10, wherein step (c) is practiced by the player placing equal first and second wagers.

15. A method according to claim 9, wherein if the dealer hand value is less than a first predetermined value, step (e) is practiced by paying a payout on the first and second wagers regardless of the first and second player hand values.

16. A method according to claim 15, wherein the first predetermined value is 6.

17. A method according to claim 15, wherein if the dealer hand value is greater than a second predetermined value, step (e) is practiced by paying a payout on the first wager if the value of the first player hand exceeds the dealer hand value and paying a payout on the second wager if the value of the second player hand exceeds the dealer hand value.

18. A method according to claim 17, wherein the second predetermined value is 5.

19. A method according to claim 18, wherein the payout is 1 to 1.

20. A method according to claim 18, wherein the first and second wagers are pushed for tied hands.

21. A method according to claim 1, wherein step (c) is practiced by the player placing equal first and second wagers.

22. A method according to claim 1, further comprising, prior to step (b), providing an option for the player to place a proposition wager, and resolving the proposition wager based on the at least two cards dealt to the player in step (b).

23. A method according to claim 22, wherein the step of resolving the proposition wager is practiced by paying a payout on the proposition wager if the at least two cards dealt to the player in step (b) form a pair.

24. A method according to claim 23, wherein the step of resolving the proposition wager is practiced by paying a higher payout on the proposition wager if the at least two cards dealt to the player in step (b) form a suited pair.

25. A method according to claim 24, wherein the step of resolving the proposition wager is practiced by paying a payout on the proposition wager if the at least two cards dealt to the player in step (b) form a pair of 2s through 9s.

26. A method according to claim 25, wherein the step of resolving the proposition wager is practiced by paying a payout on the proposition wager if the at least two cards dealt to the player in step (b) have a combined value according to the modulo-10 Baccarat scoring system of 8 or 9.

27. A method according to claim 26, wherein the step of resolving the proposition wager is practiced by paying a higher payout on the proposition wager if the at least two cards dealt to the player in step (b) form a suited pair or if the cards are suited and have the combined value according to the modulo-10 Baccarat scoring system of 8 or 9.

28. A method according to claim 27, wherein the payout on the proposition wager is paid according to one of pay tables A, B or C, defined as:

PAY TABLE A

| Player's two cards | Suited | Unsuited |
|---|---|---|
| Pair of 2's-9's | 10 | 2 |
| 8 or 9 points | 6 | 2 |

PAY TABLE B

| Player's two cards | Suited | Unsuited |
|---|---|---|
| Pair of 2's-9's | 9 | 2 |
| 8 or 9 points | 6 | 2 |

PAY TABLE C

| Player's two cards | Suited | Unsuited |
|---|---|---|
| Pair of 2's-9's | 14 | 2 |
| 8 or 9 points | 5 | 2. |

29. A method of playing a casino game using a table or at least one apparatus wherein each player makes two wagers respectively for two separate player hands and receives two cards, a dealer receives at least one card, and the dealer deals at least first and second community hands by dealing at least three cards including at least two exposed cards and at least one concealed card, the first community hand consisting of at least one of the at least two exposed cards and the at least one concealed card, and the second community hand consisting of at least the other of the at least two exposed cards and the at least one concealed cord, each player subsequently forming the two separate player hands prior to exposing the at least one concealed card by selectively combining one each of the two cards with each of the community hands, forming a dealer hand by combining the at least one card with only one of the community hands, the wagers being resolved by comparing the two player hands with the dealer hand.

30. A method according to claim 29, wherein hand values for the player hands and the dealer hand are determined according to a modulo-10 Baccarat counting system.

31. A method according to claim 30, wherein the step of dealing two community hands is practiced by dealing three cards including two exposed cards and one concealed card, a first community hand consisting of one of the exposed cards and the concealed card, and a second community hand consisting of the other of the exposed cards and the concealed card.

32. A method according to claim 29, wherein each player is provided an option to place a proposition wager, the proposition wager being resolved on a pay scale based on the two cards initially dealt to each player.

33. A method according to claim 29, wherein the cards comprise one of playing cards, dice or tiles.

34. A method of playing a casino Baccarat game using a table or at least one apparatus, wherein hand values are determined according to a modulo-10 Baccarat scoring system, the method comprising:

(a) a player placing a Left wager and a Right wager;

(b) dealing two cards to the player and one card to a dealer;

(c) dealing three community cards including an exposed first card, a concealed second card, and an exposed third card, the three community cards defining two community hands, a first community hand including the exposed first card and the concealed second card, and the second community hand including the exposed third card and the concealed second card;

(d) the player forming a first player hand by placing one of the two cards dealt to the player in step (b) in association with one of the first and second community hands;

(e) the player forming a second player hand by placing the other of the two cards dealt to the player in step (b) in association with the other of the first and second community hands;

(f) after step (e), revealing the concealed second card;

(g) determining a value of the first player hand and a value of the second player hand, wherein the now-revealed second card forms part of the first or second player hand only if the second card improves the hand value, respectively;

(h) the dealer forming a dealer hand by associating the dealer card with the first or second community hand that results an optimum hand value and determining a dealer hand value; and (i) resolving the Left wager based on a comparison of the player first hand value with the dealer hand value, and resolving the Right wager based on a comparison of the player second hand value with the dealer hand value.

35. A method according to claim 34, wherein if the dealer hand value is less than 6, step (i) is practiced by paying a payout on the Left and Right wagers regardless of the first and second player hand values.

36. A method according to claim 35, wherein if the dealer hand value is greater than 5, step (i) is practiced by paying a payout on the Left wager if the value of the first player hand exceeds the dealer hand value and paying a payout on the Right wager if the value of the second player hand exceeds the dealer hand value.

37. A method according to claim 36, wherein the payout is 1 to 1.

38. A method according to claim 36, wherein the Left and Right wagers are pushed for tied hands.

39. A method according to claim 34, wherein if the dealer hand value is greater than 5 and if the first and second player hand values are equal to the dealer hand value, the method comprising paying a double hand bonus payout based on one of the Left and Right wagers.

40. A method according to claim 39, wherein the double hand bonus payout is equal to the two times one of the Left and Right wagers.

41. A method according to claim 34, further comprising, prior to step (b), providing an option for the player to place a proposition wager, and resolving the proposition wager based on the two cards dealt to the player in step (b).

42. A method according to claim 41, wherein the step of resolving the proposition wager is practiced by paying a payout on the proposition wager if the two cards dealt to the player in step (b) form a pair of 2s through 9s or if the two cards dealt to the player in step (b) have a combined value according to the modulo-10 Baccarat scoring system of 8 or 9.

* * * * *